US010364112B2

(12) United States Patent
Giesen et al.

(10) Patent No.: US 10,364,112 B2
(45) Date of Patent: Jul. 30, 2019

(54) CENTER FEED ROLL DISPENSING APPARATUS

(71) Applicant: Amazon Technologies, Inc., Seattle, WA (US)

(72) Inventors: Harald Giesen, Chavelot (FR); Christina Kraft, Koblenz (DE); Volker Dirk Mowitz, Alzey (DE); Peter Schmidt, Obertraubling (DE); Eduard Zimmermann, Donaustauf (DE)

(73) Assignee: Amazon Technologies, Inc., Seattle, WA (US)

( * ) Notice: Subject to any disclaimer, the term of this patent is extended or adjusted under 35 U.S.C. 154(b) by 560 days.

(21) Appl. No.: 14/976,971

(22) Filed: Dec. 21, 2015

(65) Prior Publication Data

US 2017/0305652 A1 Oct. 26, 2017

(51) Int. Cl.

| | |
|---|---|
| ***A47K 10/32*** | (2006.01) |
| ***A47K 10/38*** | (2006.01) |
| ***B65H 16/00*** | (2006.01) |
| ***B65H 16/02*** | (2006.01) |
| ***B65H 75/02*** | (2006.01) |
| ***B65D 85/671*** | (2006.01) |

(52) U.S. Cl.

CPC ..... *B65H 16/005* (2013.01); *A47K 10/3818* (2013.01); *B65D 85/671* (2013.01); *B65H 16/028* (2013.01); *B65H 75/02* (2013.01); *A47K 2010/3206* (2013.01); *B65H 2301/415016* (2013.01); *B65H 2402/43* (2013.01)

(58) Field of Classification Search

CPC ..... B65H 16/005; B65H 16/028; B65H 2402/43; B65D 85/671; A47K 10/3818; A47K 2010/3206

See application file for complete search history.

(56) References Cited

U.S. PATENT DOCUMENTS

| | | | | |
|---|---|---|---|---|
| 7,131,609 | B1 | 11/2006 | Lewis et al. | |
| 2009/0026306 | A1 * | 1/2009 | Kempster | A47K 10/3818 242/593 |
| 2012/0256037 | A1 * | 10/2012 | Nordlund | A47K 10/3818 242/560 |
| 2016/0227971 | A1 | 8/2016 | Granger | |

FOREIGN PATENT DOCUMENTS

| | | | | |
|---|---|---|---|---|
| DE | 202016002839 | U1 * | 6/2016 | A47K 10/3818 |
| EP | 2159042 | A1 | 3/2010 | |
| WO | 2011072757 | A1 | 6/2011 | |

OTHER PUBLICATIONS

Extended European Search Report for EP Patent Application No. 17181532.7, dated Jan. 9, 2018, 9 pages.

* cited by examiner

*Primary Examiner* — William E Dondero
(74) *Attorney, Agent, or Firm* — Athorus, PLLC

(57) ABSTRACT

A center feed roll dispensing apparatus including: a roll support that extends in a first direction from a first end to a second end; an end wall located in the first direction with respect to the first end of the roll support, the end wall comprising a dispensing aperture; and a roll stop located in the first direction with respect to the first end of the roll support and spaced from the end wall.

20 Claims, 11 Drawing Sheets

130
132
D
160
118
112

164
162
132
134
130
160
118
112
110

132
134
130
A
110
118
112

A
B
B
B
B
B
134
150

120
122
114
150
115
122
116
113
112
122
165
163
160
164
132
134
118
110
130

CENTER FEED ROLL DISPENSING APPARATUS

BACKGROUND

The present disclosure relates to apparatus and methods for dispensing web material from a center feed roll.

WO2014/044368 discloses (see the Abstract) an example device for manually producing a helical packing material, comprising a receptacle for at least partially extensively encompassing a wound fibrous material web roll, which defines an axial direction and forms an inner side, from which the fibrous material web is drawn to form the packing material, and an axial holder, which is connected to the receptacle, wherein an axial end face of the fibrous material web roll is held on the axial holder, and a discharge opening for discharging the packing material in an axial direction is formed in the axial holder, said axial holder having an inner wall section that tapers towards the discharge opening and faces the end face.

BRIEF DESCRIPTION OF DRAWINGS

Example embodiments are described with reference to the drawings in which.

DETAILED DESCRIPTION

Figures 1A, 1B, 1C, 1D:
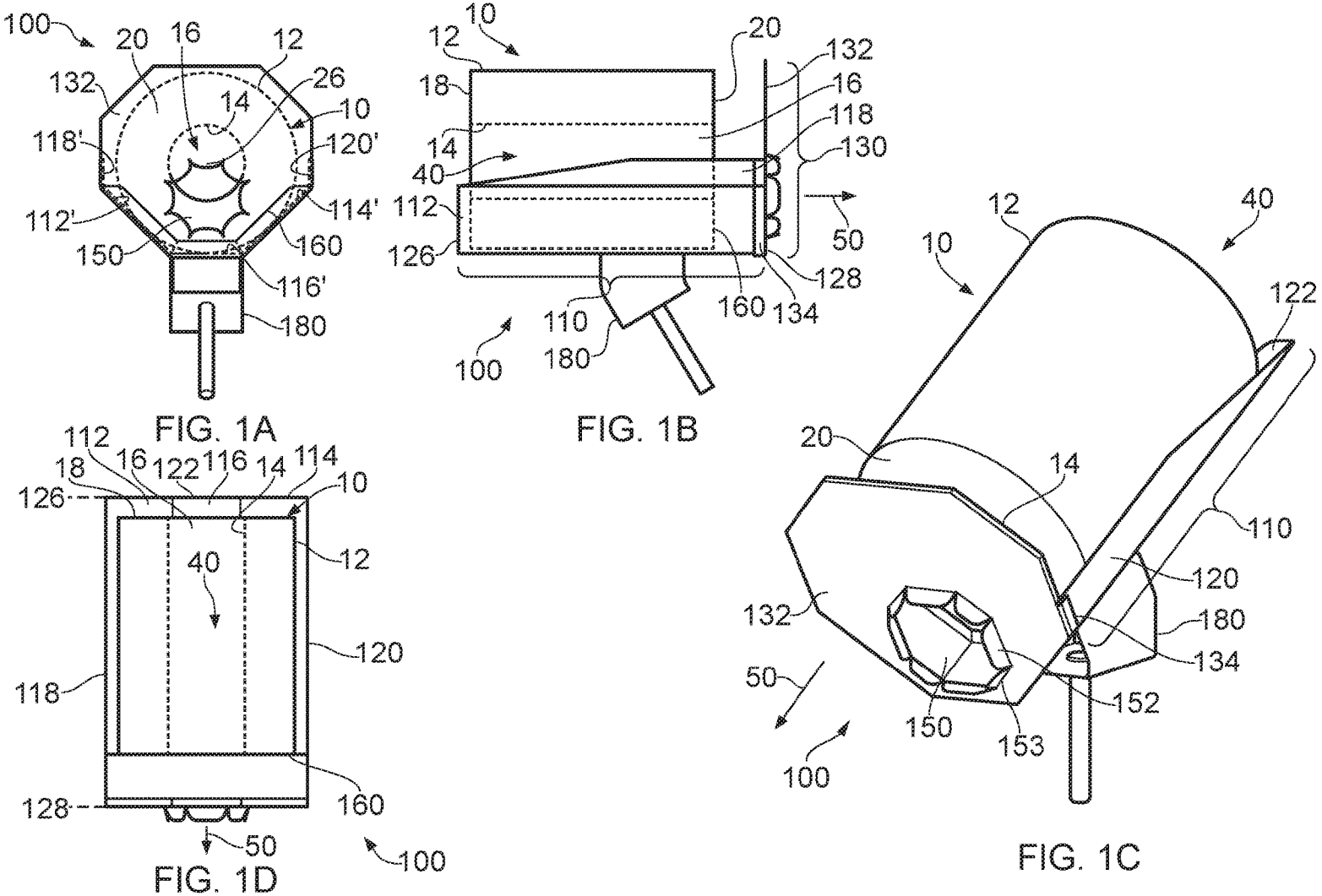
FIG. 1 is formed of FIGS. 1A, 1B, 1C and 1D and is a schematic representation of an example of a center feed roll dispensing apparatus with a center feed roll of web material located in the apparatus, according to an embodiment.

In the following description, various example embodiments are described. For purposes of explanation, specific configurations and details are set forth. However, it will also be apparent to one skilled in the art that the embodiments may be practiced without specific configurations and details of the described embodiments.

An example apparatus includes a support structure configured to support a center feed roll of web material when received in the apparatus. The support structure is described hereinafter as a roll support. The roll support extends in a first direction from a first end to a second end. The first end of the roll support is also termed a rear end, or a proximal end herein. The second end of the roll support is also termed a front end, dispensing end, or distal end of the roll support. An end wall is located in the first direction with respect to the first end of the roll support, the end wall comprising an aperture for dispensing the web material. The end wall can therefore be considered to be distal with respect to the first, proximal, end of the roll support. A roll stop is located in the first direction with respect to the proximal end of the roll support and short of the end wall such that part of a dispensing end face of the roll abuts the stop and is spaced from the end wall. The roll stop can therefore be considered to be distal with respect to the first, proximal, end of the roll support, while being short of the end wall with respect tot the first direction and therefore spaced from the end wall.

The roll stop is located short of the end wall in the first direction to be spaced from the end wall. The location of the end wall and the roll stop with respect to the roll support can vary in different embodiments. For example, in one example embodiment the end wall can be located at or short of the second end of the roll support, for example abutting the second end of the roll support. In such an embodiment, the roll stop could, for example, be located short of the second end of the roll support in the first direction. In another example embodiment, the end wall can be located beyond the end of the roll support, for example being supported by flanges that project beyond the second end of the roll support. In such an embodiment, the roll stop could, for example, be located at the end of roll support, for example being formed by one or more upstanding flanges at the second end of the roll support.

Spacing the center feed roll from the end wall facilitates loading of the center feed roll into the roll support and drawing off web material from the center winding of the roll through the dispensing aperture.

In an example apparatus the end wall is planar and perpendicular to the first direction. In an example the roll stop comprises an abutment surface that stands up from a support surface of the roll support. The roll stop can be spaced from the end wall by a distance that allows a user to insert a hand between the end wall and the end of a roll when mounted in the apparatus.

In an example apparatus the roll support provides a shallow tray, or trough-shaped, structure. The roll support can comprise a first sloping sidewall defining a first sloping surface and a second sloping sidewall defining a second sloping surface, the first surface and the second surface extending in the first direction and defining a truncated V-shaped cross-section perpendicular to the first direction that provides surfaces for supporting a roll when located in the apparatus. The roll support can further comprise a third, bottom, sidewall providing a third surface that extends in the first direction and between an edge of the first sloping surface and an edge of the second sloping surface that are closest to each other. The third surface can enhance the structure of the roll support. The roll support can further include a fourth sidewall providing a fourth surface and a fifth sidewall providing a fifth surface. The fourth surface and fifth surface each extend in the first direction and from an edge of the first surface and an edge of the second surface, respectively, that are furthest from each other. The fourth and fifth surfaces can enhance the structural rigidity of the roll support. The fourth and fifth surfaces can enhance retention of the roll in case the roll support is knocked or rocked in use. The roll support can be constructed as an integral component comprising the first to fifth sidewalls. One or more or each of the first to fifth sidewalls can be connected to the end wall to provide a rigid structure.

An example apparatus can include an upstanding flange at the first end of the roll support. The flange at the first end of the roll support can also be integral to the roll support and can be configured to enhance the structural rigidity of the roll support. The flange at the first end of the roll support can help to prevent the roll from falling from the rear of the roll support.

In an example apparatus, the roll support and the end wall can be formed from separate components fixed to each other. The roll stop can comprise a separate component fixed to at least one of a roll support component and an end wall component. Alternatively, the roll stop can be formed integrally with one of the roll support component and the end wall component, whereby the apparatus can comprise fewer component parts. For example, the roll support can include an integral roll stop wherein the roll stop is formed of an upstanding flange at the second end of the roll support. The end wall then comprises an integral flange that is attached to the roll support and/or the roll stop.

An example apparatus can comprise a mounting bracket extending from an underside of the roll support to provide a pivotal mounting for the apparatus.

In an example apparatus, a height of the roll support perpendicular to the first direction is less than a width of the roll support perpendicular to the first direction. Such a configuration can result in a low open roll support that facilitates loading of a roll into the support and can reduce the weight of the apparatus.

In an example apparatus, the end wall can have a height that is higher than the diameter of the roll. Such a configuration can provide resistance to accidental displacement of the roll over the end wall.

In an example apparatus, the aperture is located in the end wall at a position where no part of the aperture is located at a distance from the bottom of the roll support that is more than half the width of the roll support and/or no part of the aperture overlaps an expected location of an axial center of a roll received, in use, on the roll support. This configuration provides for an eccentric or off-axis draw of material from the roll when drawn from the roll through the aperture.

In an example apparatus, a center of the dispensing aperture is located at less than half the width of the roll support from a bottom of the roll support and/or a height of the end wall can be between half the width of the roll support and the width of the roll support to facilitate loading of the roll support and/or feeding of the web material from the center of the center feed roll to the dispensing aperture. The height of the end wall and the positioning of the dispensing aperture can be selected in this manner to limit unintended excessive movement of the center turning of the roll. In other words, the top of the end wall can limit movement of the center windings of the roll until the web material is fed though the dispensing aperture.

In an example apparatus the dispensing aperture comprises a plurality of curved portions (petals) arranged about the perimeter of the aperture and extending from the plane of the end wall in a direction away from the first end and are separated by gaps (niches) for tearing off portions of web material that has been fed through the dispensing aperture.

In an example apparatus the roll support and the end wall are each formed from sheet material, for example sheet metal.

In use, a center feed roll of web material can be supported by the roll support with a portion of a dispensing end of the roll abutting the roll stop to space the portion (e.g., a peripheral portion comprising some of the outer windings of the roll) of the dispensing end of the roll from the end wall. The center feed roll can be supported by the first surface and the second surface of the roll support, for example only by the first surface and the second surface, with the center feed roll not touching the one or more or any of the third, fourth and fifth surfaces. In use the center of the dispensing aperture can be below a centerline of the center feed roll of web material.

In an example embodiment of the apparatus, a device is provided that comprises: an open tray extending in a first direction from a first end to a second end; an end wall at the second end of the tray, the end wall comprising a dispensing aperture; and a stop on the tray spaced from the second end of the tray, wherein the tray is configured to receive a center feed roll of web material such that part of a dispensing end face of the roll abuts the stop and is spaced from the end wall.

In an example embodiment, the web material comprises dunnage material, for example dunnage paper.

There now follows a more detailed description of example embodiments.

FIG. 1, formed of FIGS. 1A, 1B, 1C and 1D, is a schematic representation of a center feed roll dispensing apparatus 100 with a center feed roll 10 (hereafter referred to as a roll 10) of web material located in the apparatus 100. FIG. 1A is an end view from a second end of the apparatus 100. FIG. 1B is a side view of the apparatus 100 where a first end of the apparatus is located at the left in FIG. 1B and the second end of the apparatus 100 is located at the right as shown in FIG. 1B. FIG. 1C is a perspective view of the apparatus 100 shown in FIGS. 1A and 1B. FIG. 1D is a plan view of the apparatus 100. The roll 10 comprises a spirally wound roll of web material, which is wound with successive windings from an inner winding 14 at an inner surface of the roll 10 to an outer winding 12 at an outer surface of the roll 10. The roll 10 has a central opening 16 that extends through the center of the roll 10 in an axial direction 40 (corresponding to a central axis of the roll 10) from a first, rear end 18 of the roll to a second, front, end 20 of the roll 10. The front end 20 of the roll is also referred to herein as a dispensing end of the roll 10.

The roll 10 can comprise a web of a material to be dispensed. In an example described herein, the roll comprises dunnage paper for use in packaging of goods. In some examples, the dunnage paper may have a weight of 70 or 80 gsm ($g/m^2$). However, it should be understood that in other examples the roll 10 can comprise a web of another material, for example a fibrous material such as a different form of paper, card, etc., a felt material, a foil of a metal or plastics material, etc.

An example embodiment of the apparatus 100 will now be described in more detail with reference to FIG. 1 and FIG. 2.

Figures 2A, 2B, 2C, 2D:
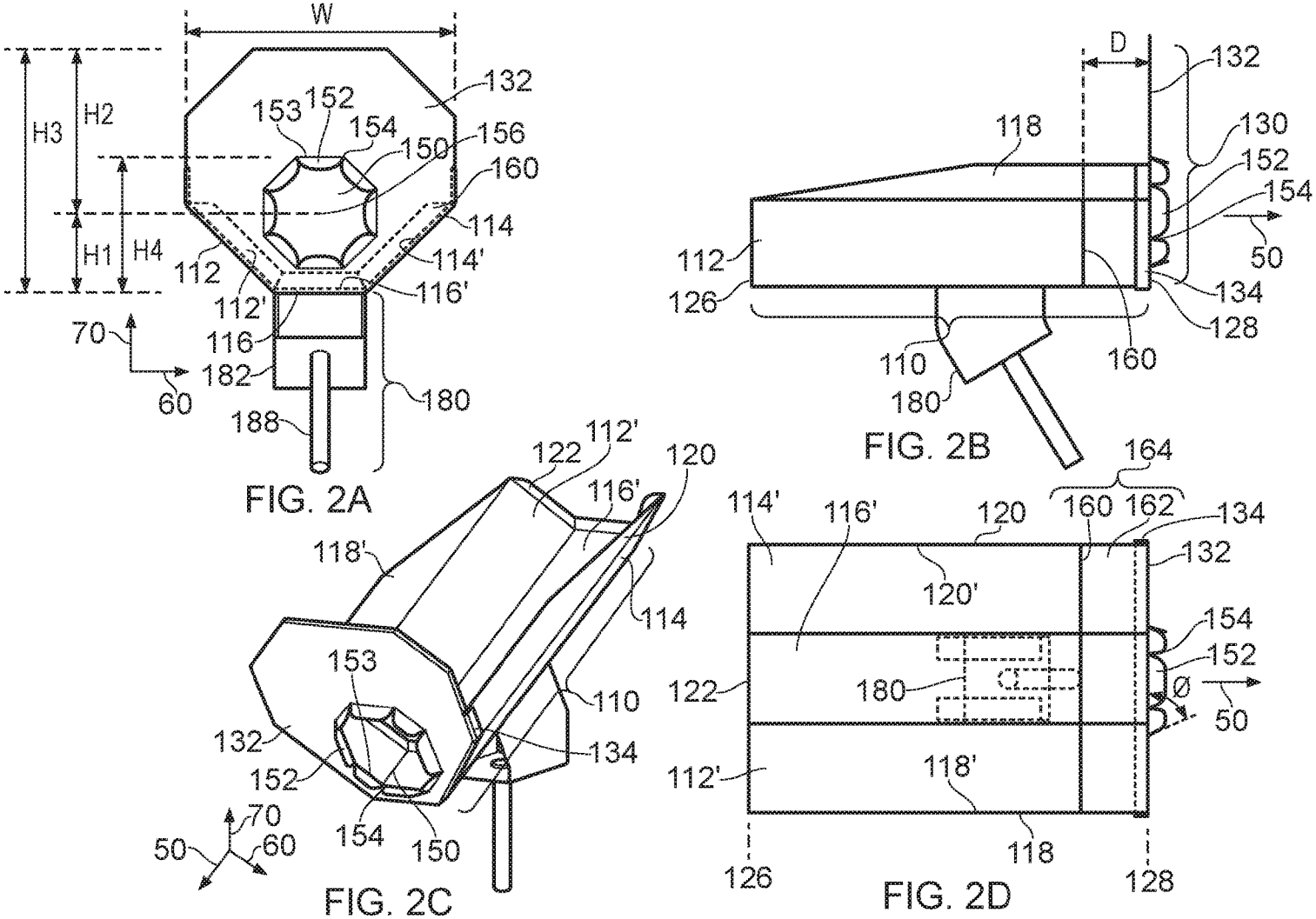
FIG. 2 is formed from FIGS. 2A, 2B, 2C and 2D and is a schematic representation of the apparatus of FIG. 1 without the roll located in the apparatus, according to an embodiment.

FIG. 2, which comprises FIGS. 2A, 2B, 2C and 2D, provides a schematic representation of an example embodiment of a center feed roll dispensing apparatus 100 without a roll in the apparatus 100. FIG. 2A is an end view from a second end of the apparatus 100. FIG. 2B is a side view of the apparatus 100 where a first end of the apparatus is located at the left in FIG. 2B and the second end of the apparatus 100 is located at the right as shown in FIG. 2B. FIG. 2C is a perspective view of the apparatus 100 shown in FIGS. 2A and 2B. FIG. 2D is a plan view of the apparatus 100.

The apparatus 100 includes a roll support 110 which forms a tray, or trough, for receiving the roll 10. The roll support 110 extends in a first direction 50 from a first, rear, end 126 of the roll support 110 to a second, front, end 128 of the roll support 110 as shown in FIG. 1B, FIG. 1D, FIG. 2B and FIG. 2D. The first direction is parallel to the axial direction of the roll when the roll is mounted in the apparatus 100. The roll support 10 has a shallow tray, or trough-shaped, configuration.

The roll support 110 comprises a first sloping sidewall 112 which extends in the first direction 50 and a second, opposing, sloping sidewall 114 that also extends in the first direction 50. In the illustrated example, each of the first and second sloping sidewalls 112 and 114 are planar and are made of sheet material. The sloping sidewalls 112 and 114 extend at an angle between a horizontal axis 60 and vertical axis 70 that are perpendicular to the first direction 50 (see FIGS. 2A and 2C). In an example embodiment the sidewalls extend at an angle between 30 to 60 degrees, for example 45 degrees, with respect to the horizontal axis 60. In use, as shown in FIG. 1A, the sloping sidewalls 112 and 114 form a first inner facing sloping surface 112' and a second inner facing sloping surface 114' on which the outer winding 12 of a roll 10 rests when located in the dispensing apparatus. The opposed sloping sidewall surfaces 112' and 114' facilitate centering of the roll 10 on the roll support 110 with respect to a plane (not shown) passing vertically though the apparatus in the first direction.

As shown in FIGS. 1 and 2, the roll support 110 includes a third, bottom sidewall 116 that extends in the first direction and between an edge of the first sloping sidewall 112 and an edge of the second sloping sidewall 114 that are closest to each other. As shown in FIG. 1A and FIG. 2A, the third, bottom sidewall 116 provides an inner facing bottom surface 116' that extends horizontally, in the direction 60, between the lower edges of the first and second sloping surfaces 112' and 114'. In an example embodiment the bottom sidewall 116 is made from the same sheet of planar material as the first and second sloping sidewalls 112 and 114.

As is further shown in FIGS. 1 and 2, the roll support 110 further includes a fourth sidewall 118 and a fifth sidewall 120 that each extend in the first direction 50 and from an edge of the first sidewall 112 and the second sidewall 114, respectively, that are furthest from each other. As shown in FIGS. 1A, 2A and 2C, the fourth and fifth sidewalls provide fourth and fifth inner facing surfaces 118' and 120', respectively that extend substantially in the vertical direction 70 from the upper edges of the first sloping surface 112' and the second sloping surface 114', respectively. As is also shown in FIGS. 1B, 1C, 2B and 2C, a rear portion (approximately the rear half) of the fourth and fifth sidewalls tapers towards the first, rear, end 126 of the roll support 10. In an example embodiment the fourth and fifth sidewalls 118 and 120 are each made from the same sheet of planar material as the first and second sloping sidewalls 112 and 114

As shown in the illustrated example, the outer winding 12 of the roll 10 rests (sits) on the first and second sloping surfaces 112' and 114', but is not in contact with the horizontal third surface 116' and the vertical fourth and fifth surfaces 118' and 120'. The third, bottom sidewall 116 can enhance the structural rigidity of the roll support. The upstanding fourth and fifth surfaces 118 and 120 provide additional structural rigidity of the apparatus through the connection to flanges 134 of the wall component 130 (as described later) and provide a supplementary function of catching a roll in the event that the apparatus 100 is knocked or rocked during operation. It is to be noted that although the overall height H4 (see FIG. 2A) of the roll support is approximately half of the height of a full roll 10 (see FIG. 1B), it is only the sloping surfaces 112' and 114' of the planar sloping sidewalls 112 and 114 that are in contact with the outer winding 12 of the roll 10 (see FIG. 1A).

At the rear, first, end of the roll support 110, a rear retaining stop is provided in the form of an upstanding flange 122. The upstanding flange 122 can be formed from an extension of the sheet material of the roll support 110 which is folded up and is joined at the intersections between the third lower surface 116' and the first and second sloping surfaces 112' and 114', respectively, to provide structural rigidity to the roll support 110. The upstanding flange 122 also serves to avoid the roll 10 sliding backwards out of the apparatus 100 in the event that the apparatus 100 is angled with the second (front) end higher than the first (rear) end.

As shown in FIGS. 1 and 2, the dispensing apparatus further comprises an end wall 132. In the illustrated example, the end wall 132 is manufactured as an end wall component 130 separate from the roll support 110 and is attached to the roll support 110 by means of flanges 134 which are folded around the outside of the roll support 110 and are attached thereto in a suitable manner. In an example embodiment, where the roll support 110 and the end wall 132 are each formed of sheet metal, the end wall component 130 can be attached to the roll support 110 using, for example, laser welding. Alternatively, or in addition, the end wall component 130 can be attached to the roll support 110 using, for example, another welding or brazing technique, suitable adhesives, or mechanical fasteners such as rivets, screws, etc.

The wall 132 is formed with a dispensing aperture 150. As shown in FIG. 1A, the aperture 150 is located below the axial center 26 of the roll 10. Thus when paper is drawn from the roll 10 through the aperture 150, the draw action is off-axis with respect to the axial center 26 of the roll 10. In the present examples, where the end wall is typically at least as tall (H3) as the outer diameter of the roll of web material, this off-axis alignment of the aperture to the axial center of the roll can be achieved by providing that the aperture falls entirely within the lower half of the end wall. In other words, the eccentric positioning of the aperture with respect to the expected location of the roll center axis can be achieved by having the aperture not extend beyond the half way point of the height of the end wall.

As shown in FIG. 2A, a height H1 of the center 156 of the dispensing aperture 150 is, depending on the aperture dimensions, approximately somewhere between one quarter and one third of the width W of the roll support 110. In the example shown in FIG. 2A, the center 156 of the dispensing aperture 150 is located at a height H1 approximately one quarter of the height H3 of the wall 132 whereby, as shown in FIG. 2A, the height H1 is approximately one third of the height H2. With further reference to FIG. 2A, the height H3 of the wall 132 is approximately equal to the width W of the roll support 110. The relative dimensions of the wall 132 and the aperture 150 can be chosen such that, in use, the central opening 16 of a roll 10 extends to within the opening provided by the dispensing aperture 150 and the axial center 26 of the roll 10 is above, level with or slightly below the upper extent of the aperture 150.

Figure 3:
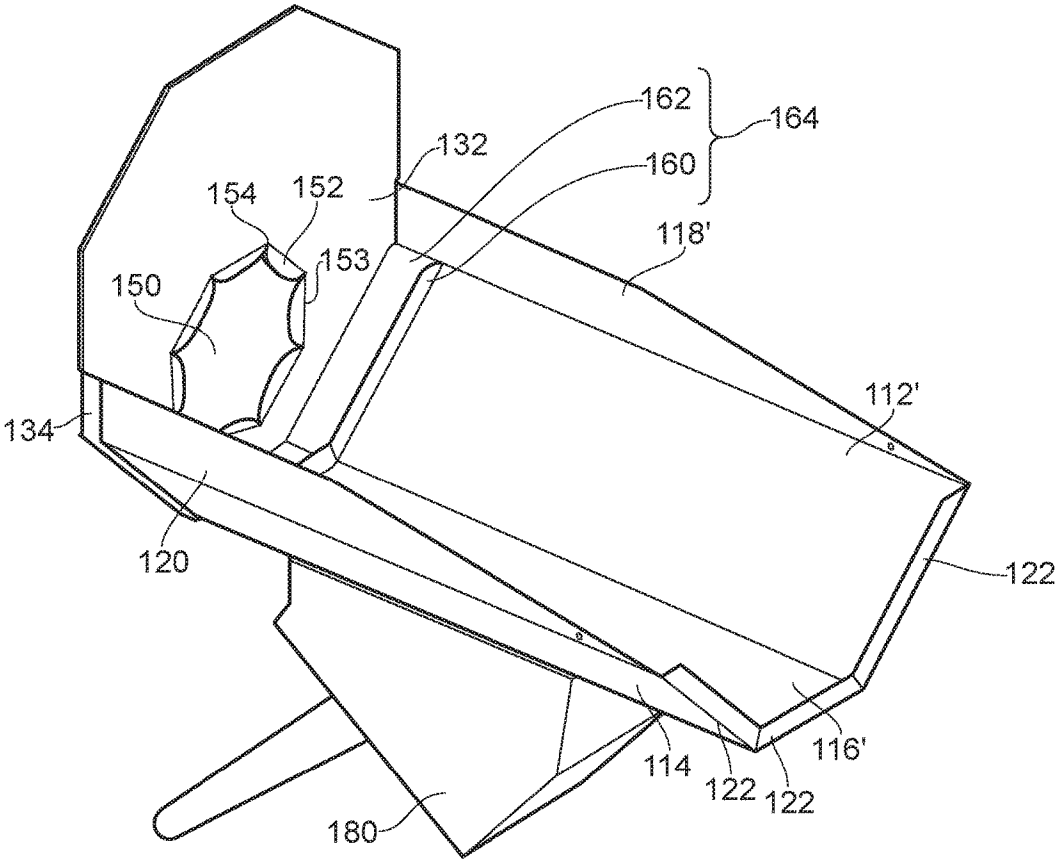
FIG. 3 is a schematic perspective view of the apparatus of FIG. 2, according to an embodiment.

FIG. 1B illustrates that, in use, the front surface 20 of the roll 10 is spaced from the wall 132 by means of an end stop 160 for a roll, hereinafter termed a roll stop 160. In an example embodiment, the roll stop 160 is in the form of an abutment surface 160 against which a portion of the front, dispensing, end 20 of the roll 10 abuts when located in the apparatus 100. As illustrated in FIG. 3, in a first example, the abutment surface 160 is in the form of an upstand which forms part of an L-shaped profile 164 that includes the upstand 160 and a spacing plate 162.

As shown in the example of FIGS. 1-3, the roll stop 160 provides an upstanding abutment surface that is located short of the second end of the roll support in the first direction and is spaced by a distance D from the wall 132 by means of the spacer 162. The roll stop can be spaced from the end wall by a distance that allows a user to insert a hand between the end wall 132 and the end of a roll 10 when mounted in the apparatus. For example, the roll stop can be spaced between 20 mm and 120 mm from the second end of the roll support, for example approximately 80 mm from the second end of the roll support. This distance D is set so as to cooperate with position of the aperture relative to the axial center of the roll to provide that paper drawn from the roll through the aperture can be drawn through the aperture without significant unintended breakage of the paper. As will be described below, the paper can be intentionally broken by use of the petals also described below.

The roll stop 160 is provided, in the example shown in FIGS. 1-3, on each of the first and second sloping surfaces 112' and 114', and also on the third, bottom, surface 116'. In other examples, the roll stop could be provided on more or less of the surfaces 112', 114', 116', 118', and 120' of the roll support 110.

In the examples shown in FIGS. 1-3, the profile 164 is manufactured as a component separate from the roll support 110 and the wall component 130, and is attached to the roll support by an appropriate attachment process, for example by laser welding or another welding or brazing technique, suitable adhesives, or mechanical fasteners such as rivets, screws, etc. In an example embodiment, the stop 160 is formed of a sheet material, such as a sheet metal.

The dispensing aperture 150 in the end wall 132 is formed with aperture edge portions or curved portions 152 which are separated by gaps (which could for example also be described as niches or slots) 154. The configuration of the curved portions 152 are described herein as "petals", with gaps 154 between the petals. As can be seen in FIGS. 1-3, the petals are arranged extending radially inwardly of the aperture perimeter and extending outwardly from the end wall 132 in a direction away from the roll 10. In other words, the petals extend in direction 50. As shown in FIGS. 1-3, the petals are angled at an angle θ relative to the plane of the end wall 132. For example the angle θ of the petals can be between 60 and 90 degrees, for example approximately 70 degrees or 85 degrees to the plane of the end wall 132. At a boundary 153 between the petals 152 and the end wall 132, the transition is in the present example a radiused transition. In other examples an abrupt transition with minimal or no radius may be provided. As will be described later with regard to operation of the apparatus, an operator can pull the web material into the gap 154 between two petals 152, to tear off a portion of the web material.

In the illustrated example, the petals 152 are manufactured integrally with the end wall component 130, by cutting the shape of the petals from the sheet material of the end wall 132 and pressing or otherwise bending the sheet material forming the petals to the angle θ, leading to a radiused angular transition at the boundary 153.

In other examples, each petal or a set of petals may be formed as a separate component that is attached to end wall 132, resulting in either a radiused or abrupt angular transition at the boundary 153. In these examples the separate petal or set of petals may be attached to the end wall by way of seam welding the petal to the edge of the aperture 150. Alternatively, this attachment may be provided by means of flanges (not shown) folded relative to the petal at the angle θ to sit on the inside or outside surface of the end wall 132 and attached thereto in a suitable manner. In an example where the end wall 132 and petals 152 are formed of sheet metal, the end wall component 130 can be attached to the roll support 110 using, for example, laser welding. Alternatively, or in addition, the attachment may be provided using, for example, another welding or brazing technique, suitable adhesives, or mechanical fasteners such as rivets, screws, etc.

Thus, when in use a roll has been inserted, a user can then take hold of the inner winding 14 of the roll 10 and pull this through the dispensing aperture 150 in the wall 132. The operator has various options for taking hold of the inner turn or winding of the roll 10, including one or more of reaching over the wall 132 and feeding the web material through the dispensing aperture 150, or reaching through the dispensing aperture 150 and pulling on the inner winding 14 of the roll 10. The operator is then able to pull the spirally wound material from the roll through the dispensing aperture 150 until an appropriate length of the material has been withdrawn. By then pulling the material upwards, downwards or sidewards with respect to the dispensing aperture, the material can be caused to be gripped in a gap 154 between two adjacent petals 152 to tear a length of material from the roll 10.

FIGS. 1-3 also show a mounting bracket assembly 180 that extends from an underside of the roll support 110 to provide a mounting for the apparatus. As shown in FIGS. 1-3, the example bracket assembly 180 comprises an angled, generally U-shaped profile extending downwardly from the bottom sidewall 116. In the present example, the U-shaped profile is provided by a support element 182. Attached to the support element is a support post 188. The bracket assembly of this example is further illustrated in FIG. 4.

Figure 4:
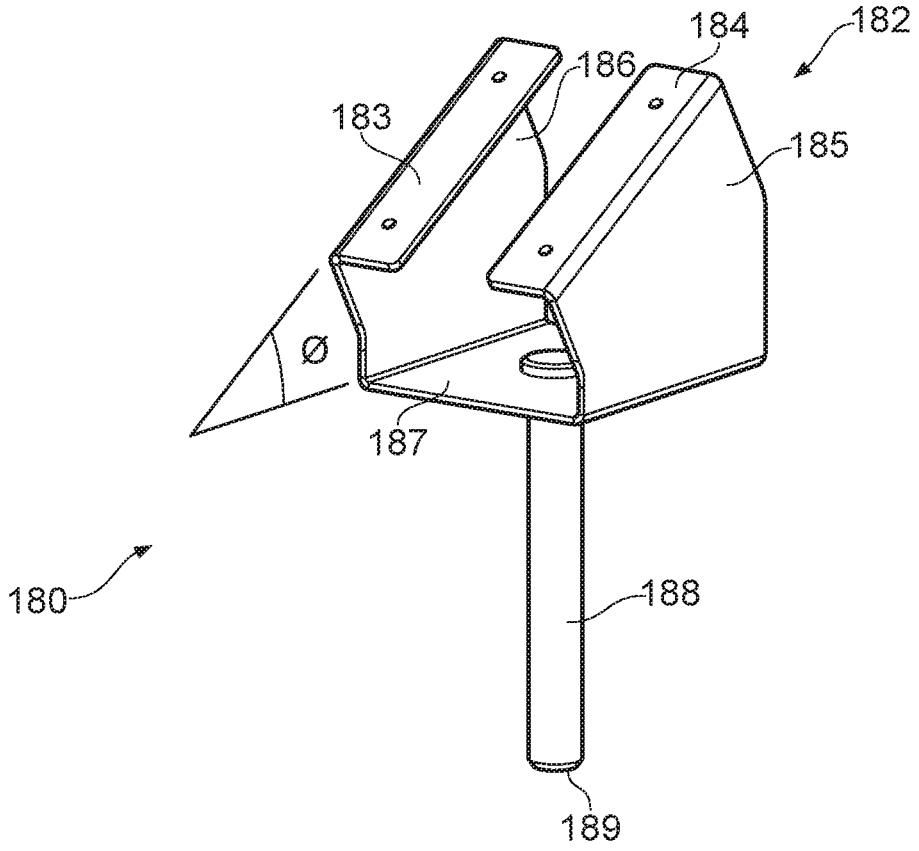
FIG. 4 is a schematic representation of a mounting bracket assembly, according to an embodiment.

As shown in FIG. 4, the support element 182 is generally U-shaped with flanges provided to facilitate attachment to the apparatus 110. Thus flanges 183 and 184 are provided for attachment to the apparatus 110, with the generally U-shaped nature being provided by support element sidewalls 185 and 186 and a support element base 187. Furthermore, the support element side walls 185 and 186 have non-parallel top (where the flanges attach) and bottom (where the base attaches) edges, so as to provide that the support element base 187 is angled with respect to the flanges 183 and 184. Thus, when the apparatus 110 is attached to the bracket assembly 180 by attachment of the apparatus bottom sidewall 116 to the flanges 183 and 184, the apparatus bottom sidewall 116 is angled with respect to the support element base 187 by an incline angle φ. In the present example the include angle φ may be between 20 and 40 degrees, for example 30 degrees. In this example, the support element 182 is formed from pressed or folded sheet material, for example sheet metal.

Connected to the support element base 187 is a support post 188. The support post is connected to the support element base 187 by for example, laser welding. Alternatively, or in addition, the support post 188 can be attached to the support element base 187 using, for example, another welding or soldering brazing technique, suitable adhesives, or mechanical fasteners such as rivets, screws, etc. The support post 188 can be attached to a suitable support structure for the apparatus 110 to be deployed. To this end, the support post 188 may be held within a hole, sleeve or clamp arrangement. Alternatively or additionally, the lower end 189 of the support post 188 may be provided with an attachment structure such as an internal bore which may be threaded or an external thread to facilitate attachment to the support structure. To accommodate different user heights and working heights, a support structure to which the mounting bracket assembly 180 is attached may be height adjustable, or multiple heights of support structures may be made available.

The dimensions of the apparatus can vary according to the dimensions of a roll 10 with which it is to be used. By way of example only, example dimensions are given below for the example of the apparatus shown in FIGS. 1 and 2 for use with a roll 10 having a length in the axial direction 40 of, for example 350 mm and an external diameter of, for example 260 mm. In an example apparatus, the roll support 110 can be, for example, 460 mm long in the first direction, with the roll stop 160 located a distance D between 40 mm and 100 mm, for example between 60 mm and 90 mm, for example 80 mm short of the end of the roll support 110. This means that a length between the roll stop 160 and the rear retaining stop 122 is longer than the axial length of the roll to be received, which facilitates mounting of the roll in the roll support 110. In the example embodiment, the height of the upstand 160 can be, for example between 10 and 40 mm, for example 20 mm. This means the upstand forms an abutment surface against which a portion of the front, dispensing, end 20 of the roll 10 abuts. In the example embodiment, the width W (see FIG. 2A) of the roll support and the end wall can be, for example, 305 mm and a height H4 (see FIG. 2A) of the roll support 110 from the bottom surface 116' to the top of the aperture 150 can be, for example, 145 mm. A height H3 (see FIG. 2A) of the end wall 132 can be, for example, 280 mm and a height H1 (see FIG. 2A) of the center of the dispensing aperture from the bottom surface 116' of the roll support 110 can be, for example, 80 mm. The height H2 therefore can be, for example, 200 mm. The dispensing opening can have a diameter between opening petals of, for example, between 105 mm and 110 mm, for example a width of 106 mm and a height of 109 mm. The petals can be angled relative to the plane of the end wall of between 60 and 90 degrees, for example 70 degrees or 85 degrees. The petals 152 can have a length extending along the plane of the petal 152 away from the boundary 153 of between 10 and 25 mm, for example 19 mm. The flanges of the mounting bracket assembly can each have a planar dimension of 120 mm by 30 mm and the mounting bracket support element can provide an angle of between 20 and 40 degrees, for example 30 degrees between the flanges and the base. It should be emphasized that the dimensions illustrated are by way of example only, and that in any specific implementational embodiment, the dimensions may be other than as indicated while still retaining the functionality of the apparatus.

Figures 5A, 5B, 5C, 5D, 5E, 5F:
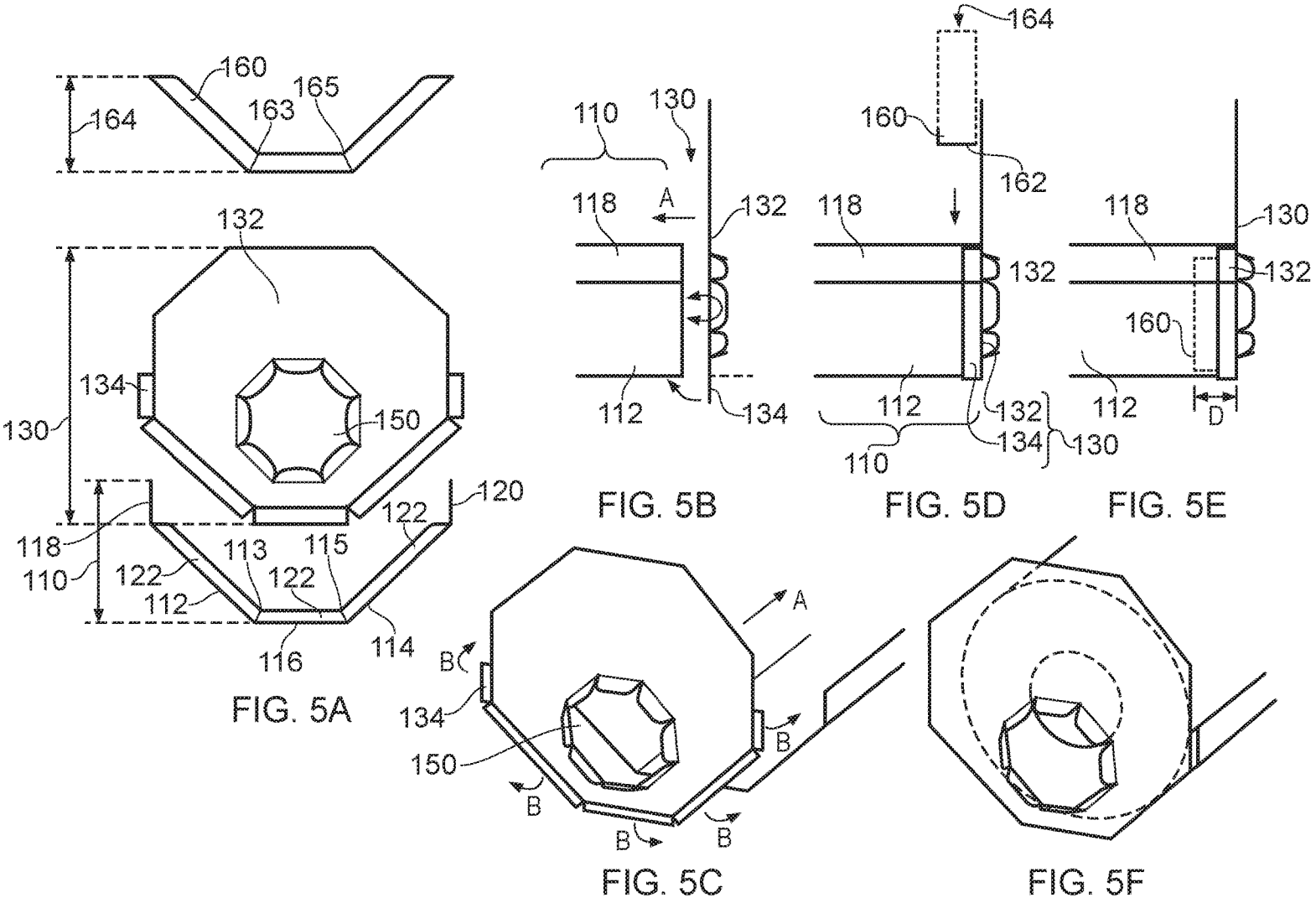
FIG. 5 is formed of FIGS. 5A, 5B, 5C, 5D, 5E and 5F and is a schematic representation of stages in manufacturing the example apparatus of FIG. 2, according to an embodiment.

FIG. 5, which comprises FIGS. 5A-5F, provides a schematic illustration of an example manufacturing process for manufacturing the apparatus shown in FIGS. 1-3. In the example shown, it is assumed that the roll support 110, the end wall component 130, and the stop component 164 are each formed of sheet metal, for example sheet steel.

FIG. 5A shows the roll support 110 from the second end after being stamped and pressed from a single piece of sheet steel to form a truncated V-shaped configuration with the sloping first and second sidewalls 112 and 114, joined by the bottom sidewall 116, and upstanding fourth and fifth sidewalls 118 and 120. FIG. 5A also shows that rear extensions of the sheet of steel of the roll support 110 projecting from the sloping sidewall portions 112 and 114 and the bottom sidewall portion 116 have been folded up to form the rear flange 122, with the flange portions extending from the respective sidewall portions 112, 114 and 116 joined at, for example, 113 and 115 by laser welding or another technique. FIG. 5A shows the wall component 130 stamped to form a blank including the wall 132 and the flanges 134 with the dispensing opening 150 in the wall 132. FIG. 5A shows the stop component 164 which has been stamped and folded to provide an L-shaped profile with the upstanding portions 160 joined at 163 and 165 using an appropriate joining technique such as laser welding to provide the truncated V-shape illustrated in FIG. 5A.

FIGS. 5B and 5C illustrate that the end wall 132 is offered up to the second end of the roll support 110 as an operation A. FIG. 5C also illustrates that in a step B after aligning the end wall with the roll support 110, the flanges 134 are folded to the outside of the respective surfaces of the roll support 110 and are attached using a suitable technique as described earlier, for example laser welding, etc.

FIG. 5D shows the wall component 130 attached to the roll support 110 by means of the flanges 134. FIG. 5D also shows the stop component 164 being offered to the part assembly comprising the roll support 110 and the wall component 130. FIG. 5E shows the stop component 164 in its final location with the roll stop 160 short of the second end of the roll support 110 spaced from the wall 130 by a distance D. The stop component 164 can be attached to the roll support 110 using an appropriate technique such as laser welding, another welding or soldering technique, suitable adhesives, rivets, screws, etc.

FIG. 5F shows the resulting assembly without the bracket 180. The bracket 180 can be attached to the underside of the roll support 110 using, for example, laser welding, another welding or soldering technique, suitable adhesives, rivets, screws, etc. at any stage before during or after the assembly process described above. It is to be noted that, for reasons of ease of illustration, the bracket assembly is not shown in FIGS. 5A-5F. It is noted the operations in the manufacturing process for manufacturing the apparatus may occur in any order. For example, the stop component 164 may be attached to the roll support 110 before the wall component 130 is attached to the roll support. Equally, the roll support 110, the stop component 164 and the wall component 130 may all be brought together at the same time and attached to each other simultaneously using an appropriate technique such as laser welding, another welding or soldering technique, suitable adhesives, rivets, screws, etc.

Figures 6A, 6B, 6C, 6D, 6E, 6F, 6G, 6H, 6I:
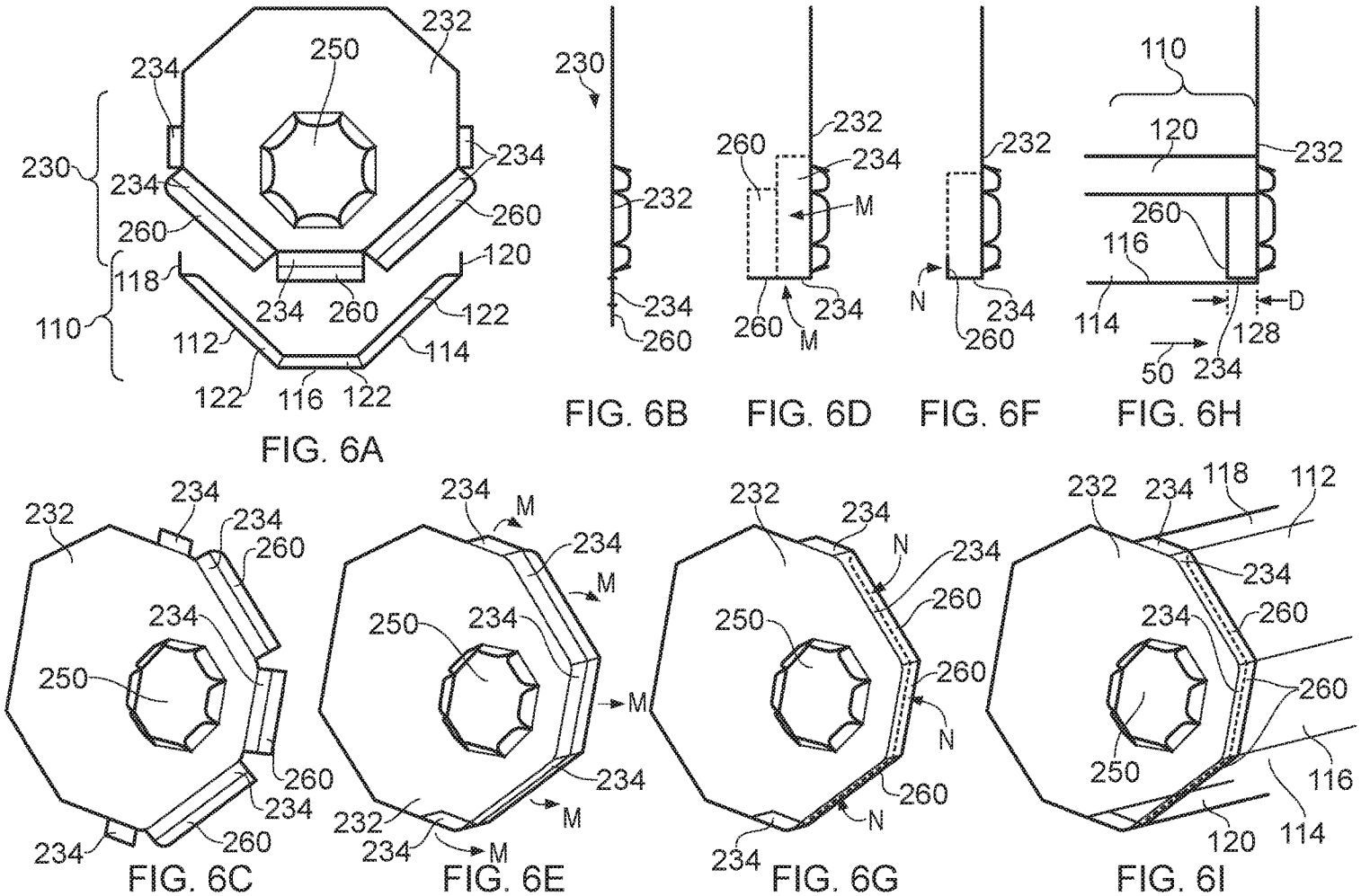
FIG. 6 is formed of FIGS. 6A, 6B, 6C, 6D, 6E, 6F, 6G, 6H and 61 and is a schematic representation of stages in manufacturing of another example apparatus, according to an embodiment.

FIG. 6 is a schematic representation of an alternative construction in which a roll stop in the form of an upstand 260 is manufactured to be integral with the end wall component rather than being constructed as a separate component. FIG. 6A illustrates an initial configuration of the roll support 110 and a blank end wall component 230 that includes the end wall 232 formed with the dispensing aperture 250, flanges 234 and further flanges 260 to form a roll stop. FIG. 6A shows the roll support 110 from the second end after being stamped and pressed from a single piece of sheet steel to form a truncated V-shaped configuration with the sloping first and second sidewalls 112 and 114, joined by the bottom sidewall 116, and upstanding fourth and fifth upstanding sidewalls 118 and 120. FIG. 6A also shows that rear extensions of the sheet of steel of the roll support 110 projecting from the sloping sidewall portions 112 and 114 and the bottom sidewall portion 116 have been folded up to form the rear flange 122, with the flange portions extending from the respective sidewall portions 112, 114 and 116 joined at, for example, 113 and 115 by laser welding or another technique. FIG. 6A shows the wall component 230 stamped to form the blank end wall component 230 including the end wall 232 formed with the dispensing aperture 250, flanges 234 and further flanges 260 to form a roll stop.

FIG. 6B shows an end view of the blank 230 illustrated in FIG. 6A. FIG. 6C is a perspective representation of the blank 232.

FIG. 6D and FIG. 6E illustrate a first step in the forming of the wall blank 230 in which the flanges 234 are bent to extend perpendicularly with respect to the end wall 232 by folding in the direction M illustrated in FIGS. 6D and 6E.

FIGS. 6F and 6G illustrate a second step in forming of the end wall component in which the further flanges 260 are folded in the direction N to form upstands as roll stops 260 corresponding generally to the roll stops 160 of FIGS. 1-5.

FIGS. 6H and 6I show the end wall after being offered up to the second end of the roll support 110 whereby the flanges 234 are configured to sit within the roll support 110 and with the upstand 260 forming a roll stop short of the end of the roll support 110 in the first direction, spaced a distance D from the end wall 232.

Where the components of the apparatus are made from, for example sheet steel, the components and/or the finished apparatus can be provided with a protective coating by being painted, e.g. using an electrostatically applied powder paint, or by galvanising, etc.

Figure 7:
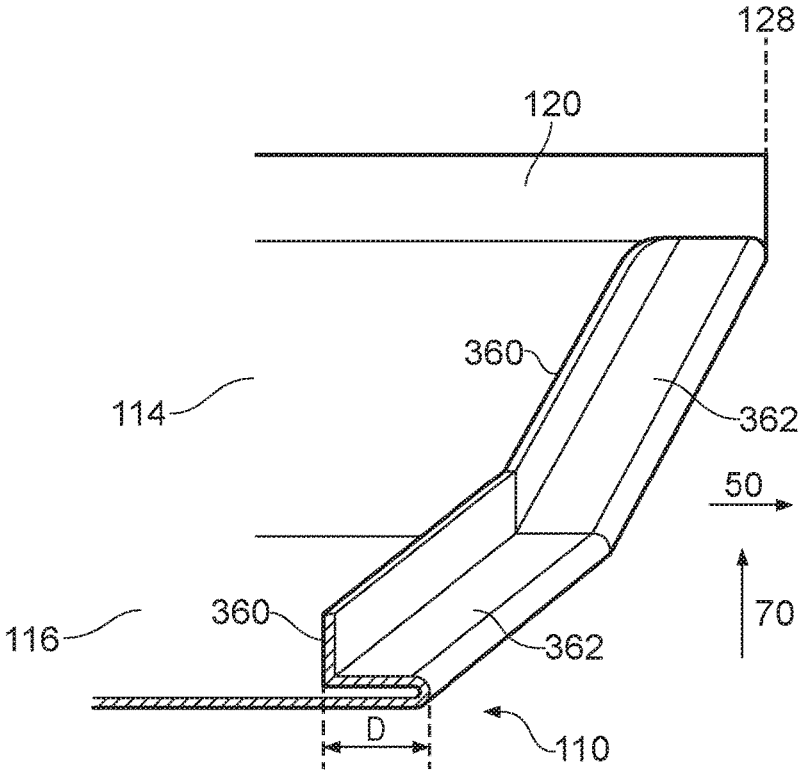
FIG. 7 is a schematic representation of the manufacture of a portion of another example apparatus, according to an embodiment.

FIG. 7 illustrates an alternative configuration for the roll support 110. FIG. 7 illustrates the roll support cut through the bottom sidewall 116 in the first direction 50. In the example shown in FIG. 7, the roll support 110 is folded, at its second front end 128, upwards and back on itself in the direction opposite the first direction 50. This forms a spacer 362. The roll support is further folded upwards to form the roll stop 360 such that the spacer is of length D. Roll stop 360 forms an abutment surface 360 against which a portion of the front, dispensing, end 20 of the roll 10 abuts when located in the apparatus 100.

Figure 8:
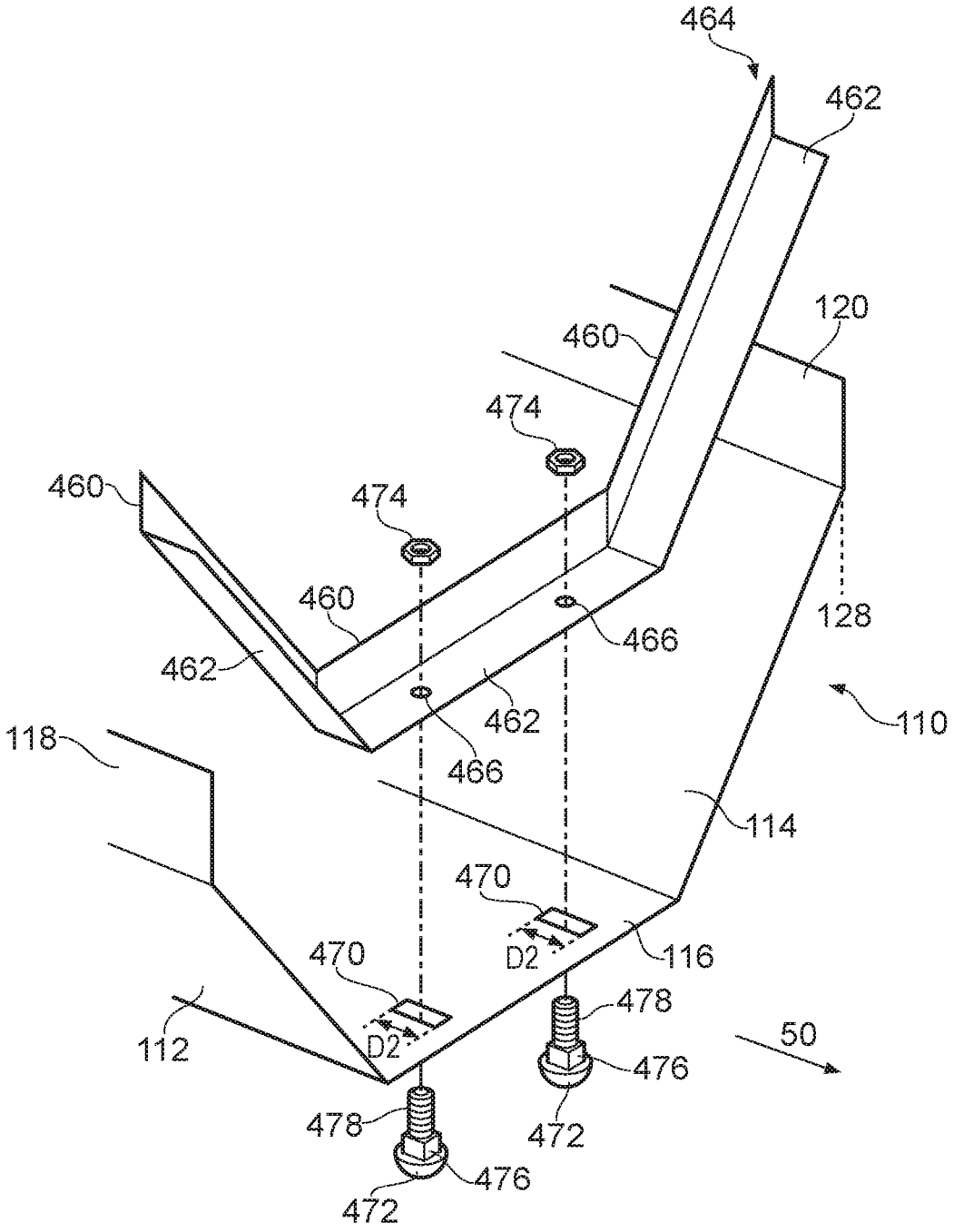
FIG. 8 is a schematic representation of the assembly of a portion of another example apparatus, according to an embodiment.

FIG. 8 illustrates an alternative means of joining a roll stop component 464 to the roll support 110. In the example illustrated in FIG. 8, the roll stop component 464 is a separate component to the roll support 110. The roll stop component 464 and the roll support 110 are attached by screws 472. Although two screws are illustrated in FIG. 8, fewer or more screws, for example 1 or 4, may be used to attach the components. The screws 472 pass from the underside of the bottom sidewall 116 through rectangular slots 470 in the bottom sidewall 116. The screws 472 have a square cross section 476 at the base of the screw thread 478 which engages in the rectangular slots 470, allowing the screws to slide in the first direction 50. The screws 472 then pass through holes 466 in the spacer plate 462 of the roll stop component 464 and are secured in place with nuts 474. In operation, the nuts 474 can be loosened to allow the screws and roll stop component 464 to be slid in the rectangular slots 470 in the first direction. This alters the distance D that the roll stop 460 is located from the second, front, end 128 of the roll support in the first direction 50. The length of the slots D2 in the first direction determines a range of motion that the roll stop may be moved through, with the minimum and maximum values of D being limited by the length of the space plate 462 and the location of the slots 470 relative to the second, front, end 128. The nuts can then be tightened when the roll stop component 464 is in the desired location to prevent the roll stop component 464 moving further. This allows the operator to increase the distance D. For example, an operator may wish to increase the distance D to improve access between the roll stop 460 and the end wall 132, for example if the operator has larger fingers or a larger forearm.

Figure 9:
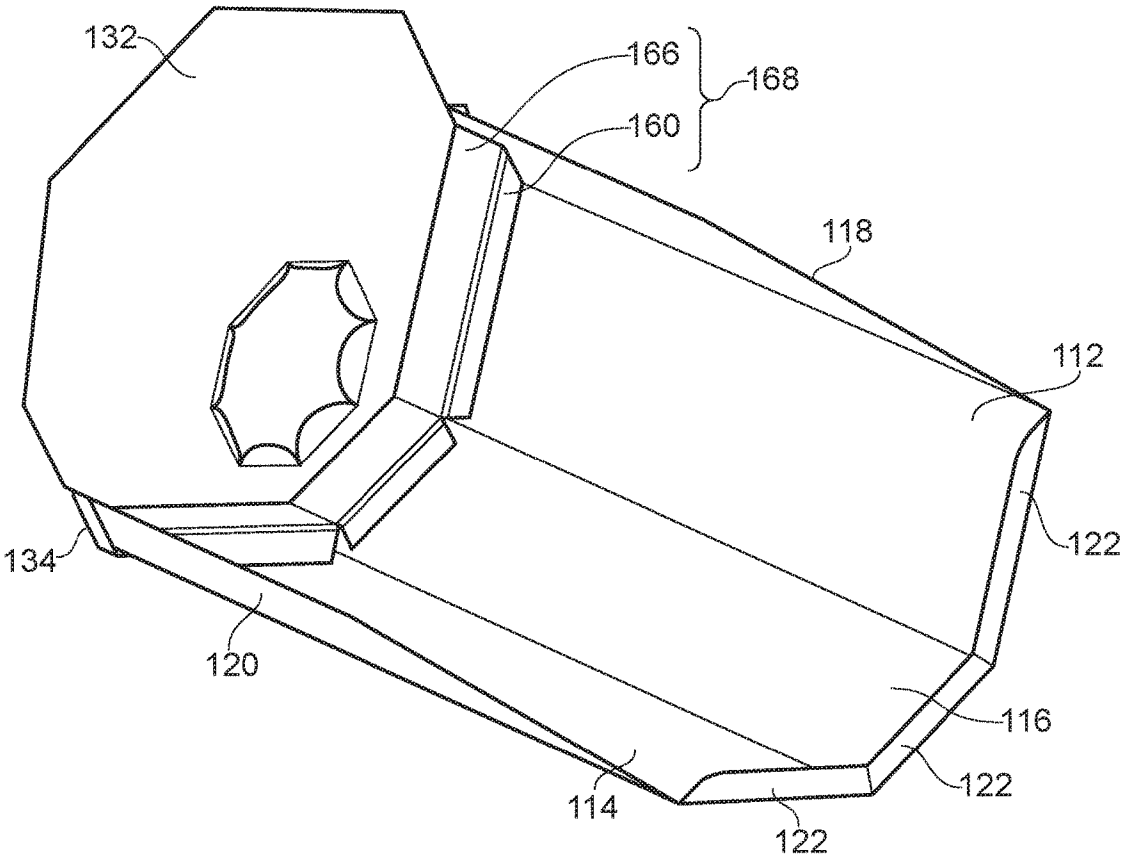
FIG. 9 is a schematic perspective view of a further example apparatus, according to an embodiment.

FIG. 9 illustrates an alternative configuration for the roll stop 160. In the example shown in FIG. 9 the construction is generally similar to the construction in FIGS. 1-5 apart from the manner in which the roll stop is formed. In FIGS. 1-5 an 'L-shaped' profile 164 is used in which a spacing flange 162 is in contact with the surfaces 112', 114' and 116' of the roll support 110 and the stop 160 forms an upstand therefrom. In FIG. 9, the stop component 168 is configured as a box section having the upstand 160 and a spacer portion 166 which extends from an upper end of the upstand 160 to the end wall 132. The box section 168 can be attached to the surfaces 112', 114' and 116' of the roll support 110 and to the wall 132 using any appropriate technique, such as laser welding, another welding or soldering technique, suitable adhesives, rivets, screws, etc.

In a further alternative configuration for the roll stop, the roll support can include an integral roll stop. In this alternative configuration, the roll stop is formed of an upstanding flange at the second end of the roll support. The wall component comprises an end wall and integral flanges that are longer than distance D, for example twice distance D. The flanges are folded to the outside of the respective surfaces of the roll support and are attached using a suitable technique as described earlier, for example laser welding, such that the upstanding flange at the second end of the roll support is spaced a distance D from the end wall. In another embodiment, the wall component flanges comprise rectangular slots, through which screws are passed to attach the wall component to the roll support as described above in relation to FIG. 8. The rectangular slots allow the wall component to be slid relative to the roll support to alter the distance D that the upstanding flange at the second end of the roll support is spaced from the end wall.

FIGS. 10 and 11 illustrate a further example of a dispensing apparatus 300, which corresponds generally to the dispensing apparatus 100 of FIGS. 1-5, with the exception that it has an end wall 332 which has a height H5 much less than a width W of the roll support 110, the aperture aligns to overlap an axial center of the roll, the aperture petals are in the plane of the end wall, the spacing D is reduced, and the support bracket facilitates an adjustable incline angle.

Figure 10B:
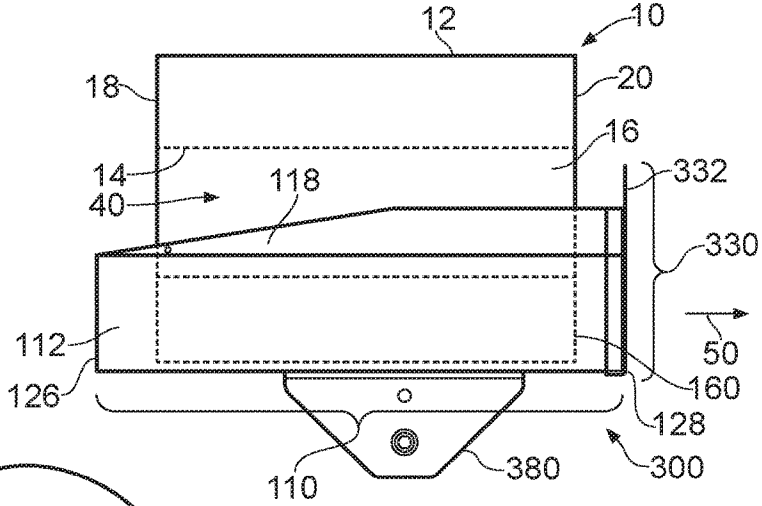
FIG. 10 is formed of FIGS. 10A, 10B and 10C and is a schematic representation of a further example apparatus with a center feed roll of web material located in the apparatus, according to an embodiment.
Figure 10C:
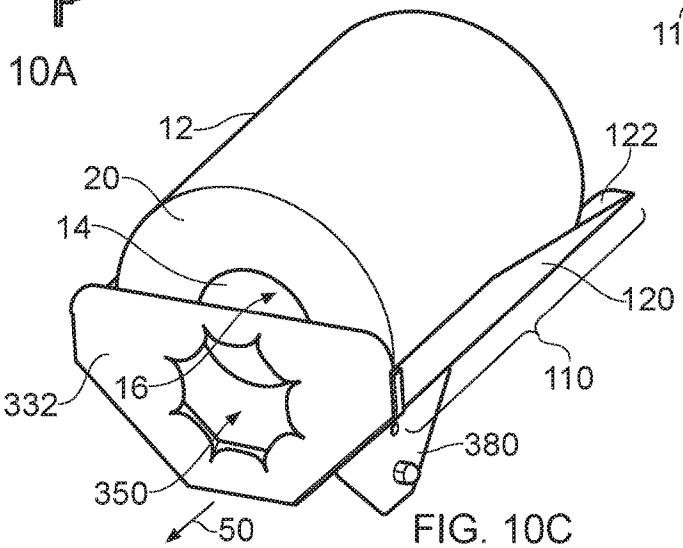
Figure 10A:
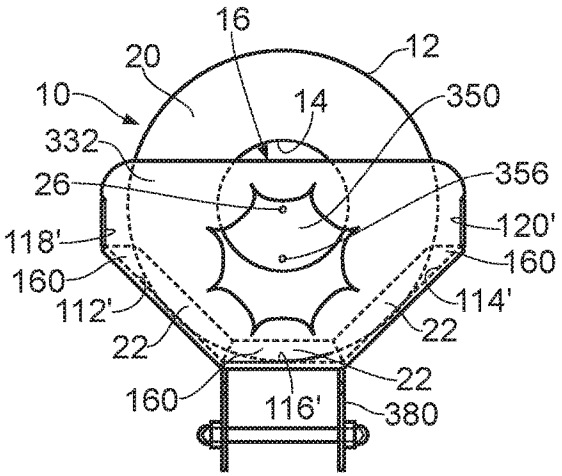

FIG. 10, formed of FIGS. 10A, 10B and 10C, is a schematic representation of a center feed roll dispensing apparatus 300 with a center feed roll 10 (hereafter referred to as a roll 10) of web material located in the apparatus 300. FIGS. 10A, 10B and 10C correspond generally to FIGS. 1A, 1B and 1C, and like numerals relate to like elements. Thus the present discussion does not re-describe all elements in common between FIGS. 1 and 10.

FIG. 11, which comprises FIGS. 11A, 11B, 11C and 11D, provides a schematic representation of the example embodiment of a center feed roll dispensing apparatus 300 shown in FIG. 10 without a roll in the apparatus. FIGS. 11A, 11B, 11C and 11D correspond generally to FIGS. 2A, 2B, 2C and 2D, and like numerals relate to like elements. Thus the present discussion does not re-describe all elements in common between FIGS. 2 and 11.

As can be seen in FIGS. 10A, 10C, 11A and 11C, the apparatus 300 includes an end wall 332. The wall 332 is formed with a dispensing aperture 350. As shown in FIG.

1A, a center 356 of the dispensing aperture 350 is located below the axial center 26 of the roll 10. In other words, the center 356 of the aperture 350 is closer to the lower extremity of the roll support 110 than the center 26 of a full roll 10 when a full roll 10 is located in the dispensing apparatus 300.

Figure 11A:
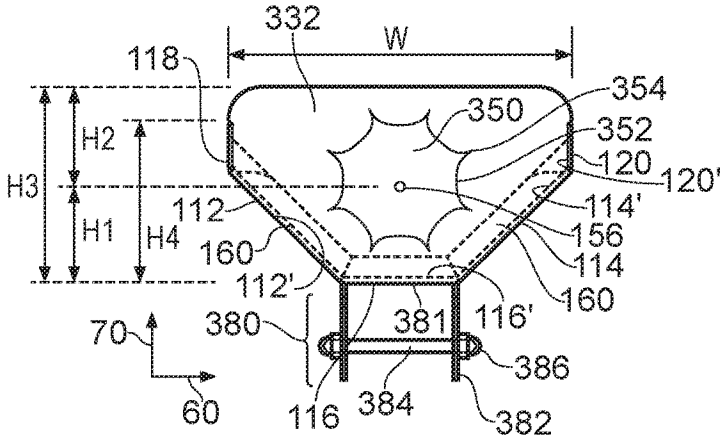
FIG. 11 is formed of FIGS. 11A, 11B, 11C and 11D and is a schematic representation of the example apparatus of FIG. 10 without the roll located in the apparatus, according to an embodiment.
Figure 11B:
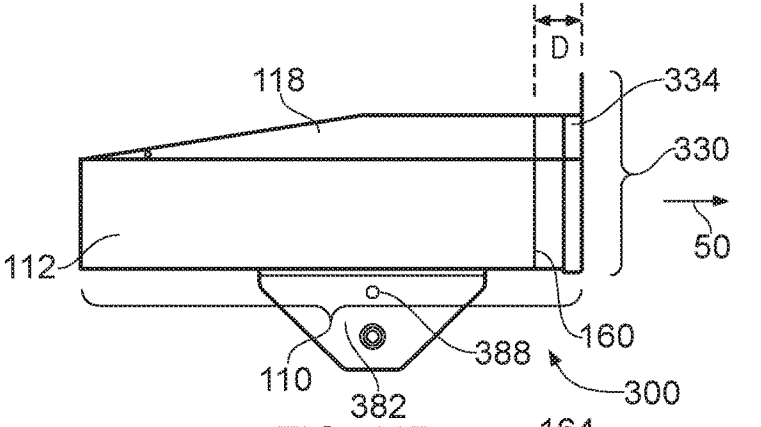
Figure 11C:
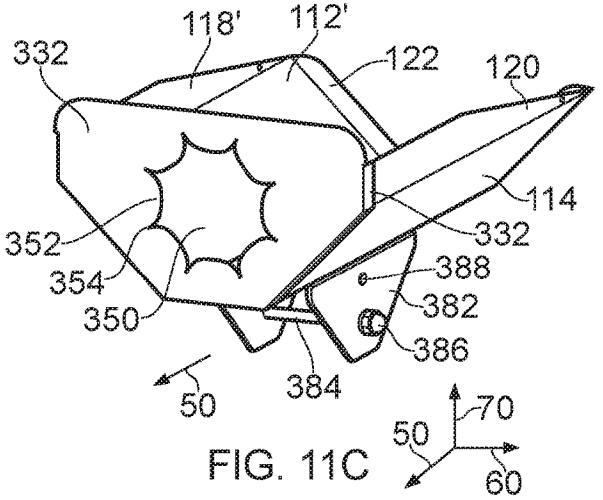
Figure 11D:
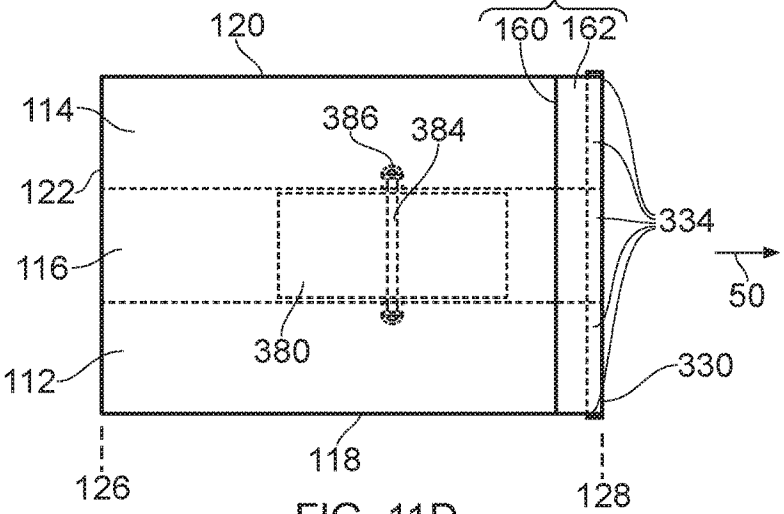

As shown in FIG. 11A, a height H1 of the center 356 of the dispensing aperture 350 is less than half of the width W of the roll support 110. In the example shown in FIG. 11A, the center 356 of the dispensing aperture 350 is located at a height H1 approximately half of the height H3 of the wall 332 whereby, as shown in FIG. 2A, the height H1 is approximately one quarter of the height H3 of the wall 132. With further reference to FIG. 11A, the height H3 of the wall 332 is greater than half of the width W of the roll support 110 and less than the width W of the roll support 110. The relative dimensions of the wall 332 and the aperture 350 can be chosen such that, in use, the central opening 16 of a roll 10 extends from above the top of the wall 332 to within the opening provided by the dispensing aperture 350. As will be appreciated, using this alignment of the aperture to the axial center of the roll will result in the drawn of material from the roll being less eccentric (i.e. less spaced apart from the axis of the roll) than using the alignment discussed with reference to FIGS. 1-3 above. It is anticipated that the alignment shown in FIG. 10A will for some web materials provide a less smooth draw of web material from the roll than the alignment shown in FIG. 1A. However, as the exact dimensions may be adapted according to the preferences of the user and the particular web material in use, it is seen that the alignment shown in FIG. 10A will provide acceptable performance for at least some web materials.

FIG. 10B illustrates that, in use, the front surface 20 of the roll 10 is spaced from the wall 132 by means of an end stop 160 for a roll, hereinafter termed a roll stop 160. The roll stop can be spaced from the end wall by a distance that allows a user to insert a hand between the end wall 132 and the end of a roll 10 when mounted in the apparatus. For example, the roll stop can be spaced between 10 mm and 80 mm from the second end of the roll support, for example approximately 40 mm from the second end of the roll support. As will be appreciated, if the alignment of the aperture shown in FIG. 10A is used, the reduced eccentricity of the draw may for some web materials permit a reduced space between the roll stop and the end wall, relative to the alignment shown in FIG. 1A, due to the reduced eccentricity of the draw from the roll to the aperture.

The dispensing aperture 350 in the end wall 332 is formed with inwardly curved portions 352 which are separated by gaps (which could for example also be described as niches or slots) 354. The configuration of the radially inwardly curved portions 352 are described herein as "petals", with gaps 354 between the petals. As described herein with regard to operation of the apparatus, an operator can pull the web material into the gap 354 between two petals 352, to tear off a portion of the web material.

FIGS. 10-11 also show a mounting bracket assembly 380 that extends from an underside of the roll support 110 to provide a pivotal mounting for the apparatus. As shown in FIGS. 10-11, the example bracket assembly 380 comprises a U-shaped profile with downwardly extending flanges 382 and a flat upper portion 381 connecting the downwardly extending flanges. Between the downwardly extending flanges, a pivot bolt 384 secured with nuts 386 provides a pivot axis. A locating hole 388 can receive a locking member for engaging with corresponding locating holes or a slot in mounting flanges (not shown) of a mount to which the mounting bracket assembly 380 is connected. The U-shaped mounting bracket 380 can also be manufactured from sheet material, for example sheet metal.

The apparatus 300 can be arranged with the first direction 50 being horizontal, or alternatively being pivoted forward or backward with respect to the horizontal for the comfort of the operator. In other words, the operator is able to adjust the angle of the first direction 50 with respect to the horizontal, typically over a range of plus or minus 30 degrees from the horizontal, based on parameters such as the height of the operator, the height of the working surface or mounting surface, etc.

As will be appreciated, the various differences between the structures shown in FIGS. 10-11 and those shown in FIGS. 1-9 may be applied individually. Thus any or all of the altered end wall size and shape, the altered petal shape and alignment, the altered spacing distance D, the altered alignment of the aperture, and the altered mounting arrangements can be applied individually, in groups or all together to the examples illustrated in FIGS. 1 to 9.

It will therefore be seen that a variety of examples of an apparatus that in use can be utilized to support a center-feed roll of web material and dispense that web material through an aperture have been described. During such use, a user of the apparatus may draw web material from the center-feed roll through the aperture, in a direction substantially parallel to the axis of the center-feed roll. Once a length of web material required by the user has been drawn through the aperture, the user may pull the web material in a direction away from the axis of the roll, and hence cause the web material to enter one or more inter-petal gaps that exist between petals formed at the aperture. Causing the web material to enter such gaps causes resistance to further drawing of web material through the aperture, and the pulling of the web material in the off-axis direction then tends to cause tearing of the web material at or near the portion of the web material in the inter-petal gap(s). Thus a desired length of web material can be dispensed by a user using the apparatus of the present teachings.

There has been described examples of a center feed roll dispensing apparatus that comprises: a roll support that extends in a first direction from a first end to a second end; an end wall at the second end of the roll support, the end wall comprising a dispensing aperture; and a roll stop located short of the second end of the roll support and spaced from the end wall.

There has been described examples of a device comprising: an open tray extending in a first direction from a first end to a second end; an end wall at the second end of the tray, the end wall comprising a dispensing aperture; and a stop on the tray spaced from the second end of the tray, wherein the tray is configured to receive a center feed roll of web material such that part of a dispensing end face of the roll abuts the stop and is spaced from the end wall.

There has also been described such an apparatus or device, further comprising a center feed roll of web material supported by the roll support with a portion of a dispensing end of the roll abutting the roll stop to space the portion of the dispensing end of the roll from the end wall.

Methods of manufacturing such an apparatus and device have been described.

Methods of use of such an apparatus and device have also been described.

The described examples of a centre feed roll dispensing apparatus facilitate easy mounting of a center feed roll in the apparatus and easy operation of the apparatus to dispense desired lengths of web material. Although particular example embodiments have been described, it will be appreciated that alternative embodiments can be envisaged.

For example, although in the described examples sheet metal, for example sheet steel, is used to form components of the apparatus 100, in other embodiments other materials could be used. For example another sheet metal, for example an aluminium alloy could be used. Also, for example, the apparatus could be manufactured from one or more plastics components, for example by moulding plastics material, such as, for example, acrylonitrile butadiene styrene (ABS), polyvinyl chloride (PVC), or polypropylene. Also, although in the described embodiments sheet materials are used to manufacture the apparatus, various portions of the apparatus, for example the roll support, could be formed from materials in the form of a mesh, or net or lattice that are either self supporting or supported on a frame. Also, as discussed, although particular example dimensions have been indicated, other embodiments are not limited to the specific embodiments and the dimensions of the apparatus can be adapted to the dimensions of a roll of center feed material to be dispensed.

Further examples consistent with the present teachings are set out in the following numbered clauses:

Clause 1 A center feed roll dispensing apparatus comprising: a roll support that extends in a first direction from a first end to a second end; an end wall located in the first direction with respect to the first end of the roll support, the end wall comprising a dispensing aperture; and a roll stop located in the first direction with respect to the first end of the roll support and spaced from the end wall.

Clause 2 The apparatus of clause 1, wherein the end wall is planar and perpendicular to the first direction.

Clause 3 The apparatus of clause 1 or clause 2, wherein the roll stop comprises an abutment surface that stands up from a support surface of the roll support.

Clause 4 The apparatus of clause 3, wherein: the end wall located at the second end of the roll support and the roll stop is spaced between 20 mm and 120 mm from the second end of the roll support, for example approximately 80 mm from the second end of the roll support; or the roll stop is located at the second end of the roll support and the end wall stop is spaced between 20 mm and 120 mm beyond the second end of the roll support in the first direction, for example approximately 80 mm beyond the second end of the roll support.

Clause 5 The apparatus of any one of the preceding clauses, wherein the roll support comprises a first surface and a second surface, the first surface and the second surface extending in the first direction and defining a partially V-shaped cross-section perpendicular to the first direction.

Clause 6 The apparatus of clause 5, wherein the roll support comprises at least one of: a third surface that extends in the first direction and between an edge of the first surface and an edge of the second surface that are closest to each other; a fourth surface and a fifth surface that extend in the first direction and from an edge of the first surface and an edge of the second surface, respectively, that are furthest from each other.

Clause 7 The apparatus of any one of the preceding clauses, further comprising an upstanding flange at the first end of the roll support.

Clause 8 The apparatus of clause 5 or any clause dependent thereon, wherein the dispensing aperture is substantially polygonal in shape, and has a plurality of curved portions arranged about the perimeter of the aperture, wherein the curved portions extend from the plane of the end wall in a direction away from the first end.

Clause 9 The apparatus of clause 8, wherein each curved portion is inclined relative to the plane of the end wall at an angle between 60 degrees and 90 degrees, for example 70 degrees or 85 degrees.

Clause 10 The apparatus of any one of the preceding clauses, wherein the dimensions of the end wall comprise at least one of: a height of the roll support perpendicular to the first direction is less than a width of the roll support perpendicular to the first direction; a center of the dispensing aperture is located at a distance from a bottom of the roll support that is less than half the width of the roll support; no part of the dispensing aperture is located at a distance from the bottom of the roll support that is more than half the width of the roll support; no part of the dispensing aperture overlaps an expected location of an axial center of a roll received, in use, on the roll support; and a height of the end wall is between half the width of the roll support and the width of the roll support.

Clause 11 The apparatus of any one of the preceding clauses, wherein the roll support and the end wall are formed from separate components fixed to each other; and the roll stop is either: a further separate component fixed to at least one of the roll support component and the end wall component; or integral to one of the roll support component or the end wall component.

Clause 12 The apparatus of any one of the preceding clauses, further comprising a mounting bracket extending from an underside of the roll support to provide a mounting for the apparatus.

Clause 13 The apparatus of any one of the preceding clauses, further comprising a center feed roll of web material supported by the roll support with a portion of a dispensing end of the roll abutting the roll stop to space the portion of the dispensing end of the roll from the end wall.

Clause 14 The apparatus of clause 13, when dependent on clause 6, wherein the center feed roll is supported by the first surface and the second surface, for example wherein the roll is supported by the first surface and the second surface but is not in contact with at least one of third, fourth and fifth surfaces.

Clause 15 The apparatus of clause 13 or clause 14, wherein the center of the dispensing aperture is below a central axis of the roll.

Although the present teachings have been described by way of example in language specific to structural features and/or methodological acts, it is to be understood that the scope defined in the appended claims is not necessarily limited to the specific features or acts described. Rather, the specific features and acts are disclosed as example forms of implementing methods, systems and approaches consistent with the appended claims. It should be appreciated that variations and modifications may be made without departing from the scope as defined in the claims. Furthermore, where known equivalents exist to specific features, such equivalents are incorporated as if specifically referred in this specification.

What is claimed is:

1. A center feed roll dispensing apparatus comprising:

a roll support that extends in a first direction from a first end to a second end;

a planar end wall located in the first direction with respect to the first end of the roll support and being arranged substantially perpendicular to the roll support, the end wall comprising a dispensing aperture, the center of the dispensing aperture located at a distance from a bottom of the roll support that is less than half the width of the roll support; and a roll stop located in the first direction with respect to the first end of the roll support and spaced from the end wall by a distance of between 60 mm and 100 mm.

2. The center feed roll dispensing apparatus of claim 1, wherein the roll support is formed to receive a roll of web material thereon.

3. The center feed roll dispending apparatus of claim 1, wherein a top extent of the dispensing aperture is located below an axial center of a roll of web material received on the roll support.

4. A center feed roll dispensing apparatus comprising:

a roll support that extends in a first direction from a first end to a second end;

an end wall located in the first direction with respect to the first end of the roll support, the end wall comprising a dispensing aperture, wherein a center of the dispensing aperture is located at a distance from a bottom of the roll support that is less than half the width of the roll support; and a roll stop located in the first direction with respect to the first end of the roll support, wherein the roll stop is spaced from the end wall in a second direction that is opposite the first direction.

5. The apparatus of claim 4, wherein the end wall is planar and perpendicular to the first direction.

6. The apparatus of claim 4, wherein the roll stop comprises an abutment surface that stands up from a support surface of the roll support.

7. The apparatus of claim 6, wherein the end wall is located at the second end of the roll support and the roll stop is spaced between 20 mm and 120 mm from the second end of the roll support.

8. The apparatus of claim 6, wherein the roll stop is located at the second end of the roll support and the end wall is spaced between 20 mm and 120 mm beyond the second end of the roll support in the first direction.

9. The apparatus of claim 4, wherein the roll support comprises a first surface and a second surface, the first surface and the second surface extending in the first direction and defining a partially V-shaped cross-section perpendicular to the first direction.

10. The apparatus of claim 9, wherein the roll support comprises at least one of: a third surface that extends in the first direction and between an edge of the first surface and an edge of the second surface that are closest to each other; or a fourth surface and a fifth surface that extend in the first direction and from an edge of the first surface and an edge of the second surface, respectively, that are furthest from each other.

11. The apparatus of claim 4, further comprising an upstanding flange at the first end of the roll support.

12. The apparatus of claim 4, wherein the dispensing aperture is substantially polygonal in shape, and has a plurality of curved portions arranged about the perimeter of the dispensing aperture, wherein the curved portions extend from the plane of the end wall in a direction away from the first end.

13. The apparatus of claim 12, wherein each curved portion is inclined relative to the plane of the end wall at an angle between 60 degrees and 90 degrees.

14. The apparatus of claim 4, wherein dimensions of the apparatus comprise at least one of:

a height of the roll support perpendicular to the first direction is less than a width of the roll support perpendicular to the first direction;

no part of the dispensing aperture is located at a distance from the bottom of the roll support that is more than half the width of the roll support; or no part of the dispensing aperture overlaps an expected location of an axial center of a roll received, in use, on the roll support.

15. The apparatus of claim 4, wherein the roll support and the end wall are formed from separate components fixed to each other; and the roll stop is one of a further separate component fixed to at least one of the roll support or the end wall, or integral to one of the roll support or the end wall.

16. The apparatus of claim 4, further comprising a mounting bracket extending from an underside of the roll support to provide a mounting for the apparatus.

17. The apparatus of claim 4, further comprising a center feed roll of web material supported by the roll support with a portion of a dispensing end of the center feed roll abutting the roll stop to space the portion of the dispensing end of the center feed roll from the end wall.

18. The apparatus of claim 17, wherein:

the roll support comprises:

a first surface and a second surface, the first surface and the second surface extending in the first direction and defining a partially V-shaped cross-section perpendicular to the first direction; and at least one of: a third surface that extends in the first direction and between an edge of the first surface and an edge of the second surface that are closest to each other;

or a fourth surface and a fifth surface that extend in the first direction and from an edge of the first surface and an edge of the second surface, respectively, that are furthest from each other; and the center feed roll is supported by the first surface and the second surface.

19. The apparatus of claim 17, wherein at least one of a top extent of the dispensing aperture or a center of the dispensing aperture is below a central axis of the center feed roll.

20. A method of dispensing web material from a center-feed roll of web material having an axial center, the method comprising:

supporting the center-feed roll in a support structure that extends in a first direction from a first end to a second end and having two roll support surfaces each extending in the first direction and defining a partially V-shaped cross-section relative to one another perpendicular to the first direction;

locating the center-feed roll against a roll stop located in the first direction with respect to the first end of the support structure; and passing material from the center-feed roll through a dispensing aperture formed in a planar end wall that is located in the first direction with respect to the first end of the support structure and is spaced from the roll stop by a distance of between 60 mm and 100 mm;

wherein the locating step comprises locating the center-feed roll such that the distance of the axial center of the center-feed roll from a bottom of the support structure is greater than a distance of the dispensing aperture from the bottom of the support structure.

* * * * *